US005546363A

United States Patent [19]

Funaki et al.

[11] Patent Number: 5,546,363

[45] Date of Patent: Aug. 13, 1996

[54] CLOCK APPARATUS FOR FORMING TIME INFORMATION FOR USE IN COMPUTER SYSTEM

[75] Inventors: Jun Funaki; Shoji Tenma, both of Kawasaki, Japan

[73] Assignee: Fujitsu Limited, Japan

[21] Appl. No.: 358,725

[22] Filed: Dec. 19, 1994

[30] Foreign Application Priority Data

Mar. 3, 1994 [JP] Japan ..... 6-033374

[51] Int. Cl.[6] ..... G04B 17/12

[52] U.S. Cl. ..... 368/200; 368/202

[58] Field of Search ..... 368/200–202

[56] References Cited

U.S. PATENT DOCUMENTS 4,443,116 4/1984 Yoshida et al. ..... 368/202

4,513,259 4/1985 Frerking ..... 368/202

4,737,944 4/1988 Inoue et al. ..... 368/201

5,412,624 5/1995 Yocum ..... 368/200

*Primary Examiner*—Bernard Roskoski

*Attorney, Agent, or Firm*—Staas & Halsey

[57] ABSTRACT

A commercially available clock IC which is easily influenced by a temperature change or the like is used as it is, thereby easily allowing the clock IC to function as a high precision clock IC. A high precision oscillator is provided separately from a clock circuit as a clock IC. On the basis of a clock signal from the high precision oscillator, a predetermined time, for example, one minute is measured by a high precision clock control circuit. A correction signal is transmitted to the clock circuit as a clock IC from a high precision control circuit every measurement of such a predetermined time, thereby allowing the correcting operation of the time information to be executed. The clock circuit is, consequently, made operative at a precision of the high precision oscillating circuit.

8 Claims, 13 Drawing Sheets

CLOCK APPARATUS FOR FORMING TIME INFORMATION FOR USE IN COMPUTER SYSTEM

BACKGROUND OF THE INVENTION

The invention relates to a clock apparatus for forming time information of a year, month, day, hour, minute, and second which is used in a small computer system and, more particularly, to a clock apparatus of high precision which can continuously form time information at a high precision.

Hitherto, in a large computer system, time data is displayed by using a binary counter of about 64 bits. According to such a binary counter, initial values are set to, for example, 1990, Jan. 1, 00 hour, 00 minute, 00 second as a Greenwich mean time and time data of year, month, day, hour, minute, and second is calculated from differences between the present time and the time based on the initial values. In such a large computer system, by raising a precision of the binary counter, a precision of the time data can be raised. However, the use of software is indispensable to calculate the time data and such a method is not general in small computer systems such as a workstation and a server.

On the other hand, in an inexpensive computer such as a personal computer or the like, time data is generally displayed by using an IC for a clock (hereinafter, also referred to as a clock IC). The clock IC has therein an oscillator and displays time data of year, month, day, hour, minute, and second by BCD codes. Further, a leap year is also calculated by the clock IC. The clock IC has a high function although its price is low. Those clock ICs have an interface with a general CPU. Therefore, by connecting the commercially available clock IC and the general CPU by a CPU bus, the time data with a high function can be cheaply displayed. The conventional clock IC having therein an oscillator, however, has drawbacks such that the internal oscillator is easily influenced by a temperature change or the like and it is difficult to maintain a stable oscillating frequency and a precision is low.

Under such situations, in small computer systems such as a workstation, server machine, and the like whose number is increasing in recent years, a request of a clock apparatus of a high precision which is almost equivalent to a large computer system is started for file management or the like. The use of such a cheap clock IC, however, cannot satisfy the needs for a high precision. There is also a problem such that it is not practical in a small computer system to use a binary counter of the bit number similar to the large computer and to calculate the time data by software.

SUMMARY OF THE INVENTION

According to the invention, there is provided a clock apparatus of a high precision which uses a clock IC of a low precision as it is and which can easily function as a clock IC of a high precision.

According to the invention, in addition to a clock circuit as a clock IC having therein a first oscillator, a second oscillator of a high precision is provided and a predetermined time, for example, one minute is measured by a high precision clock control circuit on the basis of a clock signal from the second oscillator. Each time such a predetermined time is measured, a correction signal is sent from the high precision control circuit to the clock circuit as a clock IC, thereby performing a correcting operation of time information. Thus, the clock circuit can be made operative at the precision of the second oscillator.

That is, the clock circuit which can be realized by a commercially available clock IC forms the time information on the basis of the clock signal of the built-in first oscillator which is easily influenced by a temperature change and the time information can be corrected on the basis of a correction signal from the outside. For instance, the clock circuit corrects the value of the second of the time information on the basis of the correction signal from the outside. Namely, when the correction signal is received from the outside, assuming that the value of the second in the time information is equal to or larger than 0 second and is less than 30 seconds, the value of the second in the time information is corrected to 0. When such a value is equal to or larger than 30 seconds and is equal to or less than 59 seconds, the value of one minute is carried, thereby correcting the value of second to 0. A clock circuit of the type to which an oscillator is attached from the outside can be also used as a clock circuit.

In the second oscillator provided newly, an oscillating circuit section is enclosed in a package having a thermostatic structure. A high precision clock control circuit repeats the measurement of a predetermined unit time on the basis of the clock signal from the second oscillator and generates a correction signal to the clock circuit every completion of the measurement of the unit time, thereby allowing the time information to be corrected.

The high precision clock control circuit has therein a sync control circuit and a correction signal transmitting circuit. When receiving a synchronization instruction signal from the outside, the sync control circuit synchronizes the time information based on the clock signal from the high precision oscillator with the time information in the clock circuit. As a synchronizing method, a counter (one-minute counter) to form the time information is reset by a time interruption signal of every predetermined time unit, for example, a one-minute interruption signal which is generated from the clock circuit, thereby synchronizing with the time information of the clock circuit. After completion of the synchronization by the sync control circuit, the correction signal transmitting circuit repeats the measurement of a predetermined unit time, for example, one minute on the basis of the clock signal from the high precision oscillator and transmits a correction signal to the clock circuit every completion of the measurement of the unit time, thereby allowing the time information to be corrected.

Further, there is provided a sync interruption generating circuit for transmitting a synchronization instruction signal to the high precision clock control circuit by a command from a computer apparatus. The sync interruption generating circuit decodes an initializing command in association with the turn-on of a power source of the computer apparatus and supplies the synchronization instruction signal to the high precision clock control circuit. A high precision clock selecting circuit allows the high precision clock control circuit to transmit the correction signal to the clock circuit by a command. For example, at the time of the operation by an AC power source, a selection signal is supplied to the high precision clock control circuit, thereby allowing it to function as a high precision clock. At the time of the operation by a battery power source, the supply of the selection signal to the high precision clock control circuit is suppressed and only the clock circuit is made operative, thereby reducing an electric power consumption.

According to such a clock apparatus of the invention, the predetermined time is measured by the high precision clock control circuit on the basis of the clock signal from the high precision oscillator provided separately from the clock IC and the correcting operation of the clock IC is executed by a signal derived every measurement of the predetermined time. The commercially available clock IC, consequently, can be made operative at the precision of the high precision oscillator by a simple construction.

The above and other objects, features, and advantages of the present invention will become more apparent from the following detailed description with reference to the drawings.

DETAILED DESCRIPTION OF THE PREFERRED EMBODIMENT

Figure 1:
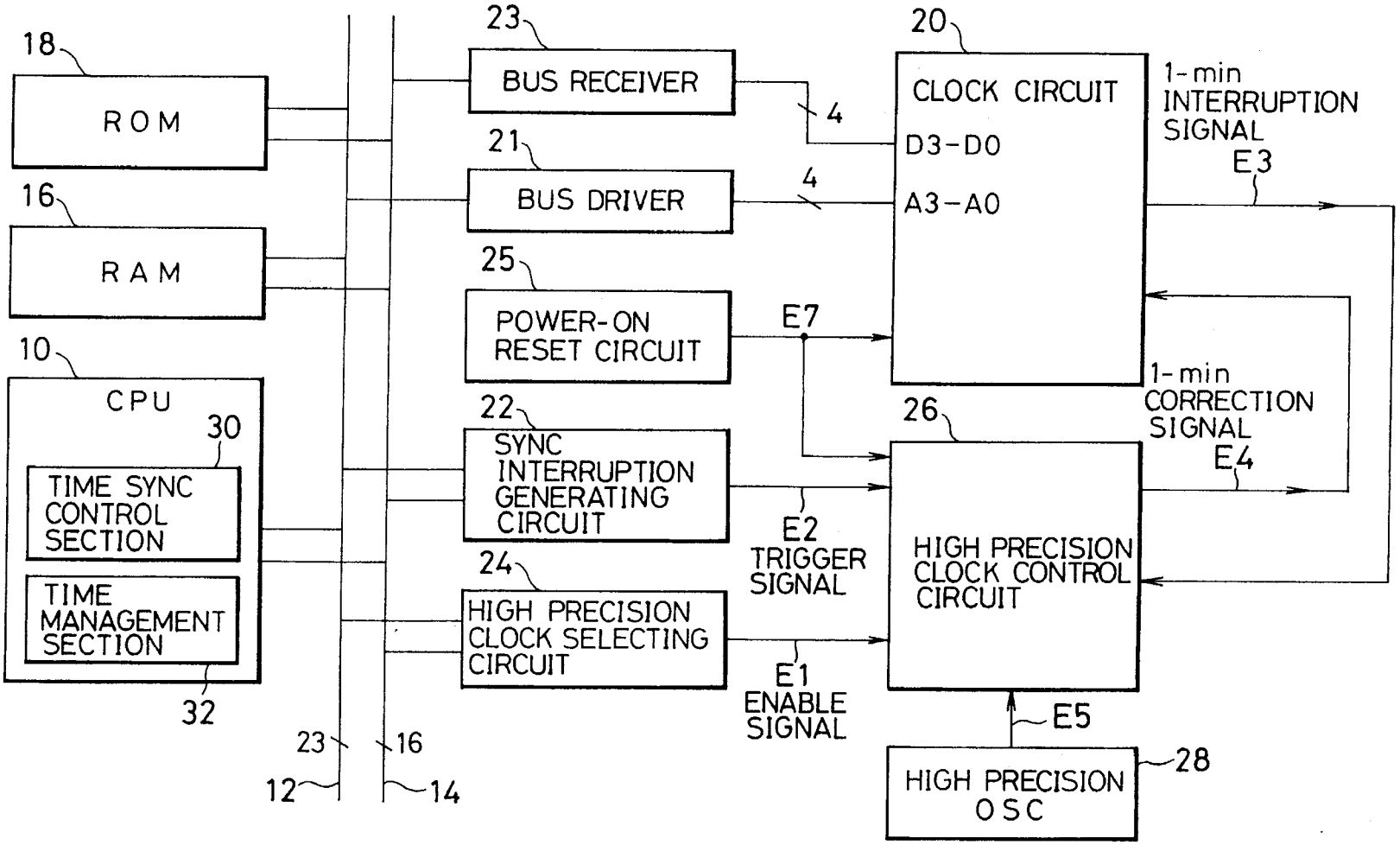
FIG. 1 is a block diagram showing an embodiment of the invention.

In FIG. 1, an address bus 12 and a data bus 14 are provided for a CPU 10. For example, MC68000 made by Motorola Semiconductor Co., Ltd. is used as a CPU 10. The address bus 12 is constructed by 23 bits of A22 to A0. The data bus 12 is constructed by 16 bits of D15 to D0. An RAM 16 and an ROM 18 are connected to the address bus 12 and data bus 14.

A clock apparatus of the invention comprises: a clock circuit 20 having therein a first oscillator using a commercially available clock IC; a high precision clock control circuit 26; and a high precision oscillator 28 as a second oscillator. The clock circuit 20 is connected to the address bus 12 of the CPU 10 through a bus driver 21. The bus driver 21 takes out lower four bits of the address bus 12 and supplies addresses A3 to A0 to the clock circuit 20. The clock circuit 20 is connected to the data bus 14 of the CPU 10 through a bus receiver 23. The bus receiver 23 transmits time data of D3 to D0 of four bits from the clock circuit 20 to the lower four bits of the data bus 14, thereby enabling the time data to be fetched into the CPU 10. Further, the clock circuit 20 has a one-minute interruption signal output terminal 20-1 and a correction signal input terminal 20-2. The one-minute interruption signal output terminal 20-1 generates a one-minute interruption signal E3 each time one minute is measured by the clock circuit 20. When the one-minute correction signal is input from the outside, the correction signal input terminal 20-2 executes the correcting operation according to the value of the second formed by a built-in one-minute counting circuit. That is, the value of the second is reset to 0 when the value of the second, when the one-minute correction signal is input, is equal to or larger than 0 second and is less than 30 seconds. When the value of the second is equal to or larger than 30 seconds and is equal to or less than 59 seconds, the carrying operation of the value of one minute is performed and the value of the second is also reset to 0.

Figure 2:
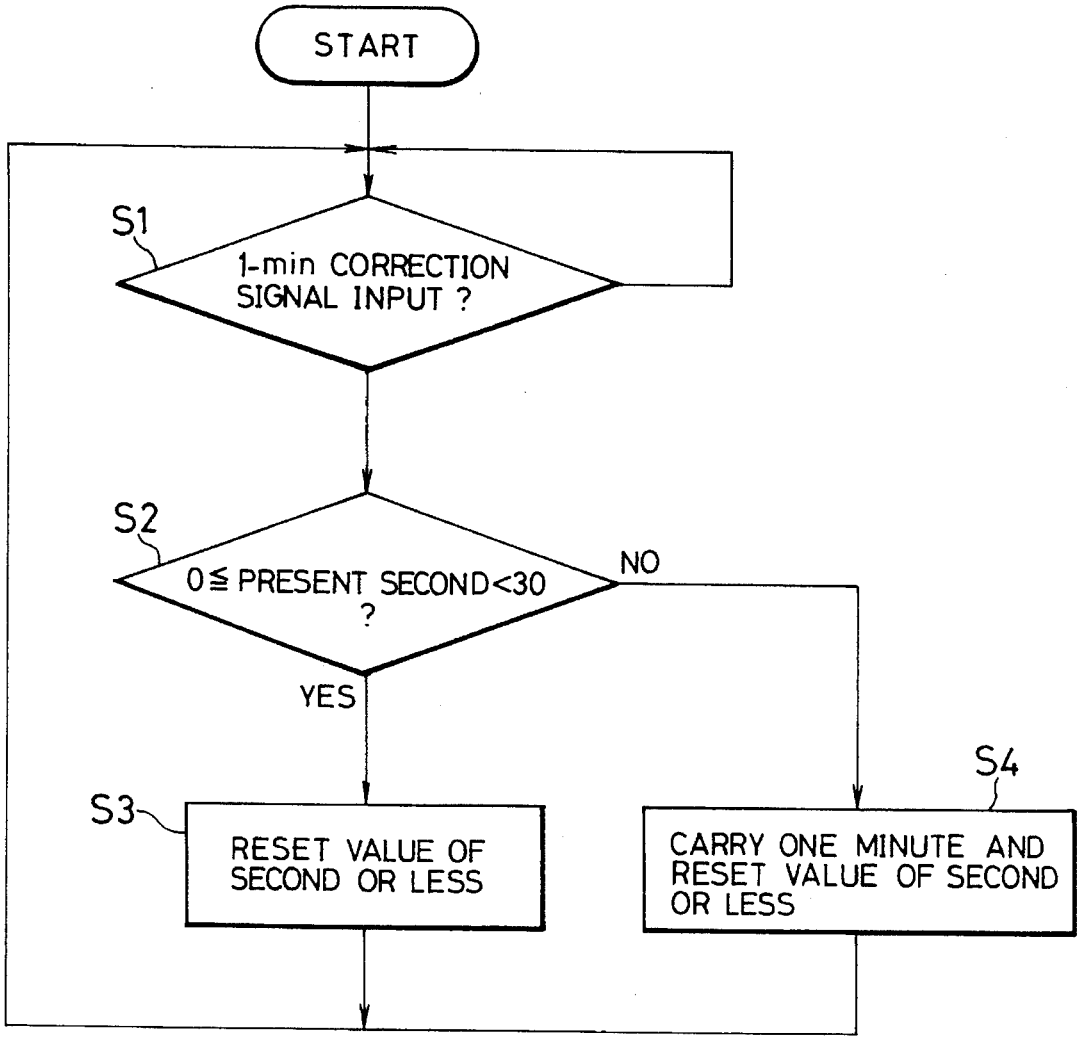
FIG. 2 is a flowchart showing a correcting process of a clock circuit.

A flowchart of FIG. 2 shows a correcting process in the clock circuit 20 in FIG. 1. First in step S1, a check is made to see if the one-minute correction signal has been input to the correction signal input terminal 20-2 from the outside or not. When the one-minute correction signal is input from the outside, step S2 follows and a check is made to see if the value of the second which is at present being counted is equal to or larger than 0 second and is less than 30 seconds or not. When the present value of the second is equal to or larger than 0 second and is less than 30 seconds, step S3 follows and the value of the second is reset to 0. When the present value of the second is equal to or larger than 30 seconds and is equal to or less than 59 seconds, step S4 follows and what is called a one-minute counter which forms the value of one minute is carried and the value of a second counter which forms the value of second is also reset to 0. As a clock circuit 20 having the correcting function by the one-minute correction signal from the outside and the function for outputting the one-minute interruption signal each time one minute is counted by the one-minute counter as mentioned above, for instance, a real-time clock module of RTC63423AA made by Epson Co., Ltd. can be used.

Referring again to FIG. 1, the high precision oscillator 28 is provided for the high precision clock control circuit 26. A quartz oscillator with a temperature compensation, a quartz oscillator with a thermostat, or the like is used as a high precision oscillator 28. The quartz oscillator with a temperature compensation is formed by combining a thermosensitive device such as a thermistor or the like and a resistor and is constructed so as to set off temperature characteristics of a quartz resonator. For instance, there is a digital quartz oscillator TCO-111A made by Toyo Communication Machine Co., Ltd. as such a quartz oscillator with a temperature compensation. In the quartz resonator with a thermostat, the ambient temperature of a quartz resonator is held constant by a thermostat, thereby improving the temperature characteristics. As such a quartz oscillator with a thermostat, for example, there is OCX 9161A made by Japan Radio Industry Co., Ltd.

Referring again to FIG. 1, the high precision clock control circuit 26 receives the one-minute interruption signal E3 which is output from the clock circuit 20 and generates a one-minute correction signal E4 to the clock circuit 20. The one-minute interruption signal E3 from the clock circuit 20 is used to synchronize the clock circuit 20 with the counting operation of a counter provided for the high precision clock control circuit 26 by a power-on-reset in association with the turn-on of the power source of the computer system. After completion of the synchronization with the clock circuit 20, the high precision clock control circuit 26 executes the measuring operation of one minute based on a 16-MHz clock signal E5 from the high precision oscillator 28 and outputs the one-minute correction signal E4 to the clock circuit 20 when the measuring operation of one minute is completed. The correcting operation of the clock circuit 20 is performed by the one-minute correction signal E4 from the high precision clock control circuit 26. The clock circuit 20 cannot produce the time data of a high precision according to the high precision oscillator 28.

Further, a sync interruption generating circuit 22, a high precision clock selecting circuit 24, and a power-on resetting circuit 25 are provided for the high precision clock control circuit 26. The power-on resetting circuit 25 outputs a reset signal E7 to the clock circuit 20 and high precision clock control circuit 26 by the timer operation in association with the turn-on of the power source, thereby allowing the initialization reset to be performed. The sync interruption generating circuit 22 decodes a command from a timer sync control section 30 provided for the CPU 10 and generates a trigger signal E2 as a synchronization instruction signal to the high precision clock control circuit 26. By receiving the trigger signal E2, the high precision clock control circuit 26 makes the input of the one-minute interruption signal E3 from the clock circuit 20 effective and executes the processing operation for synchronization.

The high precision clock selecting circuit 24 receives a command from a time management section 32 provided for the CPU 10 and supplies an enable signal E1 to select the presence or absence of the output of the one-minute correction signal E4 by the high precision clock control circuit 26. The discrimination about whether the enable signal E1 has been generated or not is performed, for instance, in accordance with the kind of power source which is used in the computer apparatus of the invention. For example, when the system is operated by the AC power source, the high precision clock selecting circuit 24 generates the enable signal E1 and allows the high precision clock control circuit 26 to output the one-minute correction signal E4, thereby making the clock circuit 20 operative at a high precision that is determined by the high precision oscillator 28. On the other hand, when the power is switched from the AC power source to the built-in battery power source, the transmission of the enable signal E1 is inhibited and the clock circuit 20 is made operative by only the built-in oscillator of a low precision, thereby stopping the function as a high precision clock apparatus. The sync interruption generating circuit 22 and high precision clock selecting circuit 24 uses a part of the function of the firmware of the computer system for the CPU 10. For example, the sync interruption generating circuit 22 decodes the address bus 12 and data bus 14 and generates a necessary control signal. As one of the functions, the trigger signal E2 is generated as a synchronization instruction signal of the high precision clock control circuit 26. The high precision clock selecting circuit 24 is a firmware to control the RAM 16 and ROM 18. As a function of a part of the firmware, the selective output of the enable signal E1 to permit the output of the one-minute correction signal E4 from the high precision clock control circuit 26 is executed.

Figure 3:
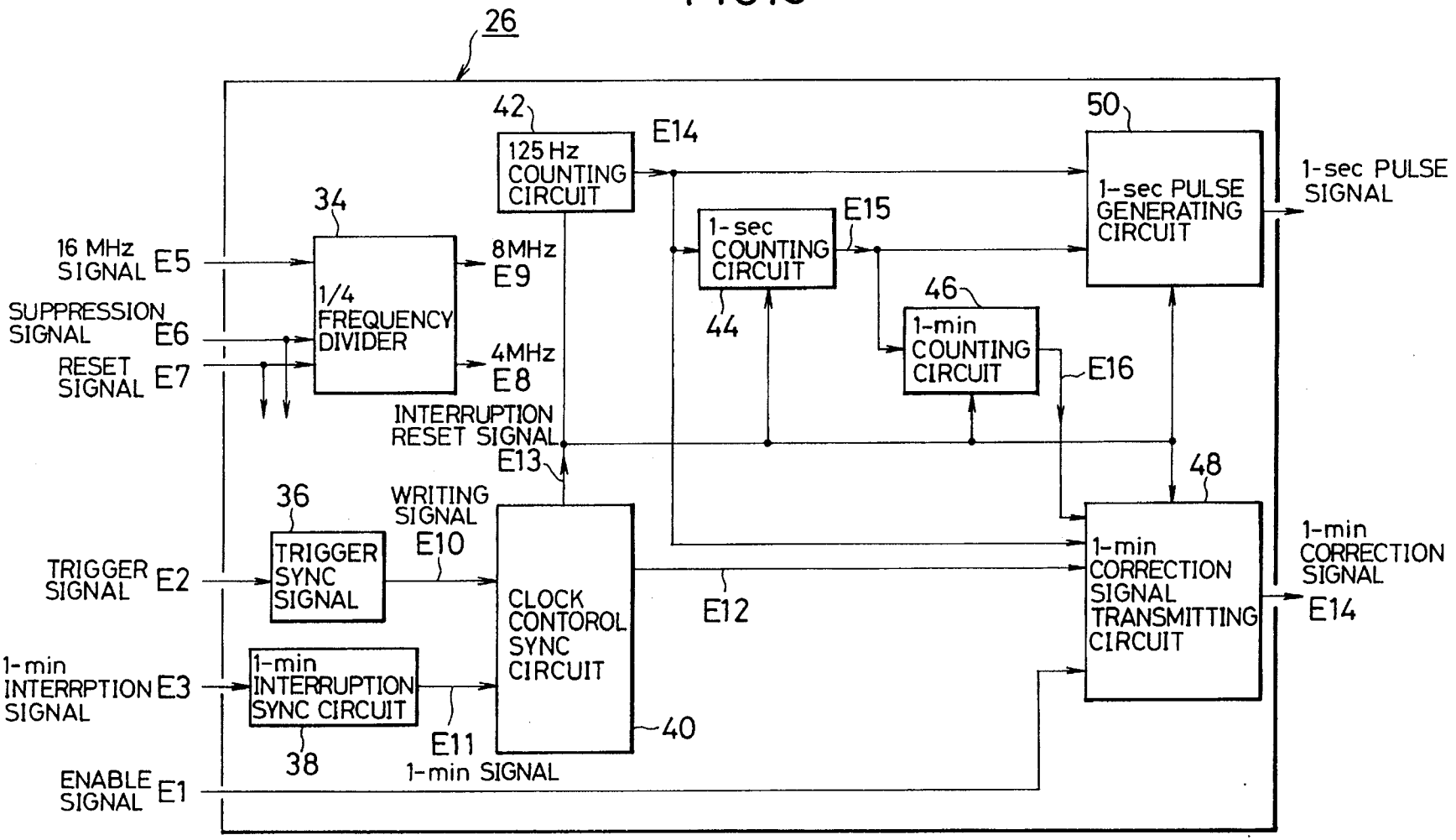
FIG. 3 is a block diagram of a high precision clock control circuit in FIG. 1.

FIG. 3 shows an embodiment of the high precision clock control circuit 26 in FIG. 1. The high precision clock control circuit 26 comprises: a ¼ frequency dividing circuit 34; a trigger sync circuit 36; a one-minute interruption sync circuit 38; a clock control sync circuit 40; a 125-Hz counting circuit 42; a one-second counting circuit 44; a one-minute counting circuit 46; a one-minute correction signal transmitting circuit 48; and a one-second pulse generating circuit 50. The ¼ frequency dividing circuit 34 receives the 16-MHz signal E5 from the high precision oscillator 28 and outputs a 4-MHz signal E8 whose frequency was divided into ¼. The 4-MHz signal E8 becomes a reference clock signal of each circuit section provided for the high precision clock control circuit 26. A suppression signal E6 and the reset signal E7 are supplied from the outside to the ¼ frequency dividing circuit 34 and are also similarly supplied to the other circuit sections. An 8-MHz signal E9 whose frequency was divided into ½ is also generated.

The trigger sync circuit 36 receives the trigger signal E2 from the sync interruption generating circuit 22 provided in the outside and latches it and generates a writing signal E10. The one-minute interruption sync circuit 38 receives the one-minute interruption signal E3 from the external clock circuit 20 and latches it and generates a one-minute signal E11. The clock control sync circuit 40 first generates an interruption reset signal E13 at a timing when both of the writing signal E10 as a latch output of the trigger sync circuit 36 and the one-minute signal E11 as a latch output of the one-minute interruption sync circuit 38 and subsequently generates a sync signal E12. The interruption reset signal E13 from the clock control sync circuit 40 is supplied to the 125-Hz counting circuit 42, one-second counting circuit 44, one-minute counting circuit 46, one-minute correction signal transmitting circuit 48, and a one-second pulse generating circuit 50, thereby allowing the interruption resetting operation to be executed.

The 125-Hz counting circuit 42 counts the 4-MHz signal E8 from the ¼ frequency dividing circuit 34 and generates a 125-Hz signal E14 of a period of 125 Hz. That is, as a 125-Hz signal E14, a clock signal of a period of 0.008 second as a reference clock of the count of one second is generated. The one-second counting circuit 44 counts the 125-Hz signal E14 from the 125-Hz counting circuit 42 and outputs a one-second signal E15. The one-minute counting circuit 46 counts the one-second circuit E15 from the one-second counting circuit 44 and outputs a one-minute signal E16. The one-minute correction signal transmitting circuit 48 receives the enable signal E1 from the outside, the sync signal E12 from the clock control sync circuit 40, the 125-Hz signal E14 from the 125-Hz counting circuit 42, and the one-minute signal E16 from the one-minute counting circuit 46. After completion of the synchronization with the clock circuit 20, the one-minute correction signal E4 synchronized with the one-minute signal E16 from the one-minute counting circuit 46 is transmitted. Although the one-second pulse generating circuit 50 is not directly concerned with the high precision clock apparatus of the invention, the generating circuit 50 produces a one-second pulse signal having a pulse width of the 125-Hz signal from the 125-Hz counting circuit 42 synchronized with the one-second signal E15 from the one-second counting circuit 44.

Figure 4:
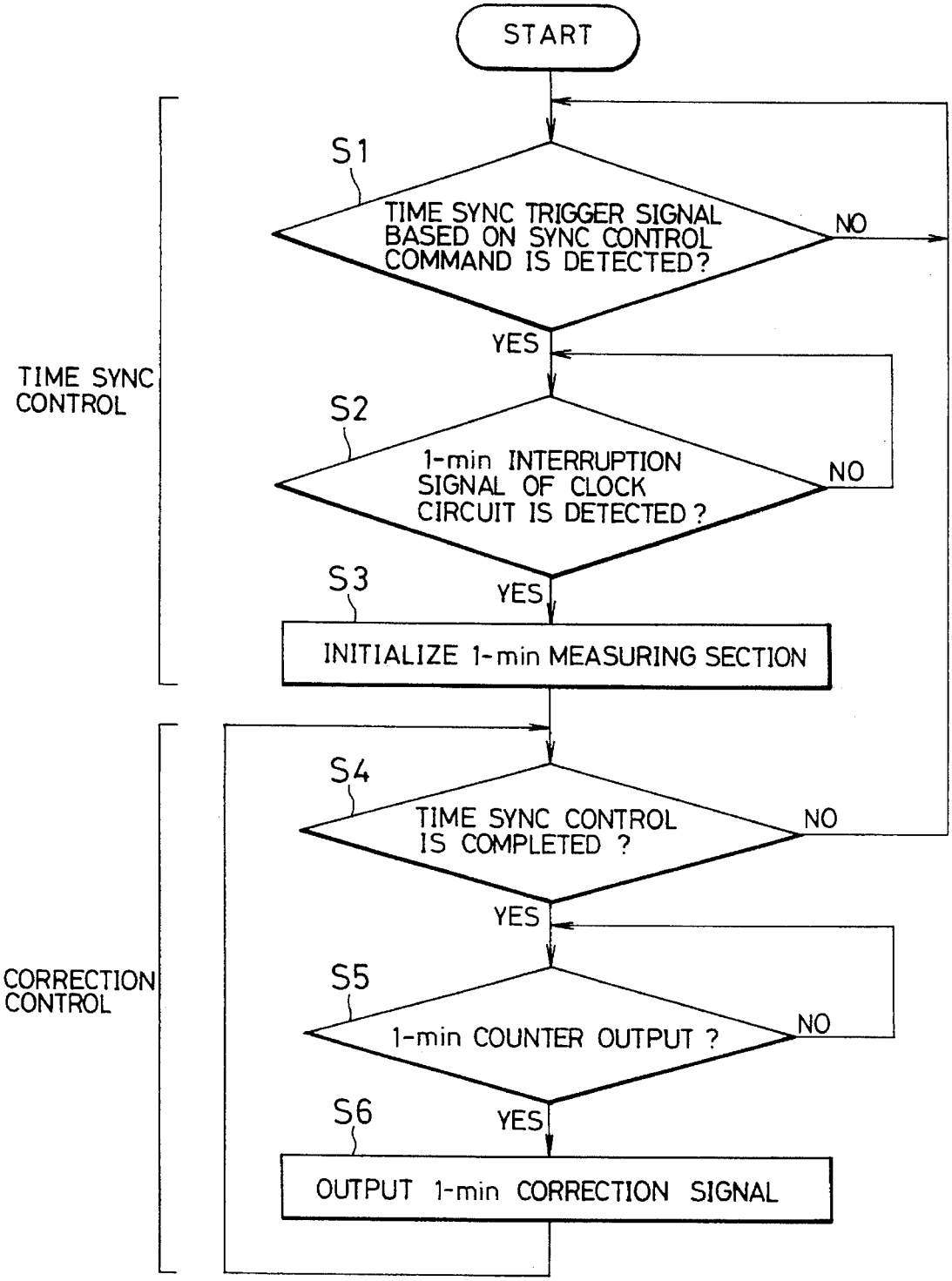
FIG. 4 is a flowchart for a synchronizing process and a correcting process of a high function clock control circuit and a clock circuit in FIG. 1.

FIG. 4 is a flowchart for the time synchronization control just after the power-on-start and the correction control after completion of the synchronization in the clock circuit 20 and high precision clock control circuit 26 in FIG. 1. Steps S1 to S3 relate to the time synchronization control of the clock circuit 20 and high precision clock control circuit 26. In the time synchronization control, first in step S1, the high precision clock control circuit 26 detects whether the trigger signal E2 from the sync interruption generating circuit 22 based on a synchronization control command from the CPU 10 has been input or not. When the input of the trigger signal E2 is detected, step S2 follows and a check is made to see if the one-minute interruption signal E3 from the clock circuit 20 has been input or not. When the input of the one-minute interruption signal E3 from the clock circuit 20 is detected, step S3 follows and an initializing process of each circuit section which performs the measurement of one minute and is provided in the high precision clock control circuit 26 is executed. Specifically speaking, the clock control sync circuit 40 in FIG. 3 generates the interruption reset signal E13, thereby resetting the 125-Hz counting circuit 42, one-second counting circuit 44, one-minute counting circuit 46, and one-minute correction signal transmitting circuit 48, respectively. Thus, the circuit section to perform the measurement of one minute in the high precision clock control circuit 26 is set to the synchronizing state for performing the time measurement synchronized with the circuit section which performs the measurement of one minute in the clock circuit 20. After completion of the time synchronization control in steps S1 to S3, the correction control of the time shown in steps S4 to S6 is repeated. First in step S4, a check is made to see if the time synchronization control has been completed or not. If YES, step S5 follows and a check is made to see if the measurement of one minute has been completed or not. That is, a check is made to see if the one-minute signal E16 has been generated from the one-minute counting circuit 46 built in the high precision clock control circuit 26 or not. When the one-minute counter output is obtained, step S6 follows and the one-minute correction signal E4 is output to the clock circuit 20.

Figures 5A, 5B, 5C, 5D, 5E, 5F:
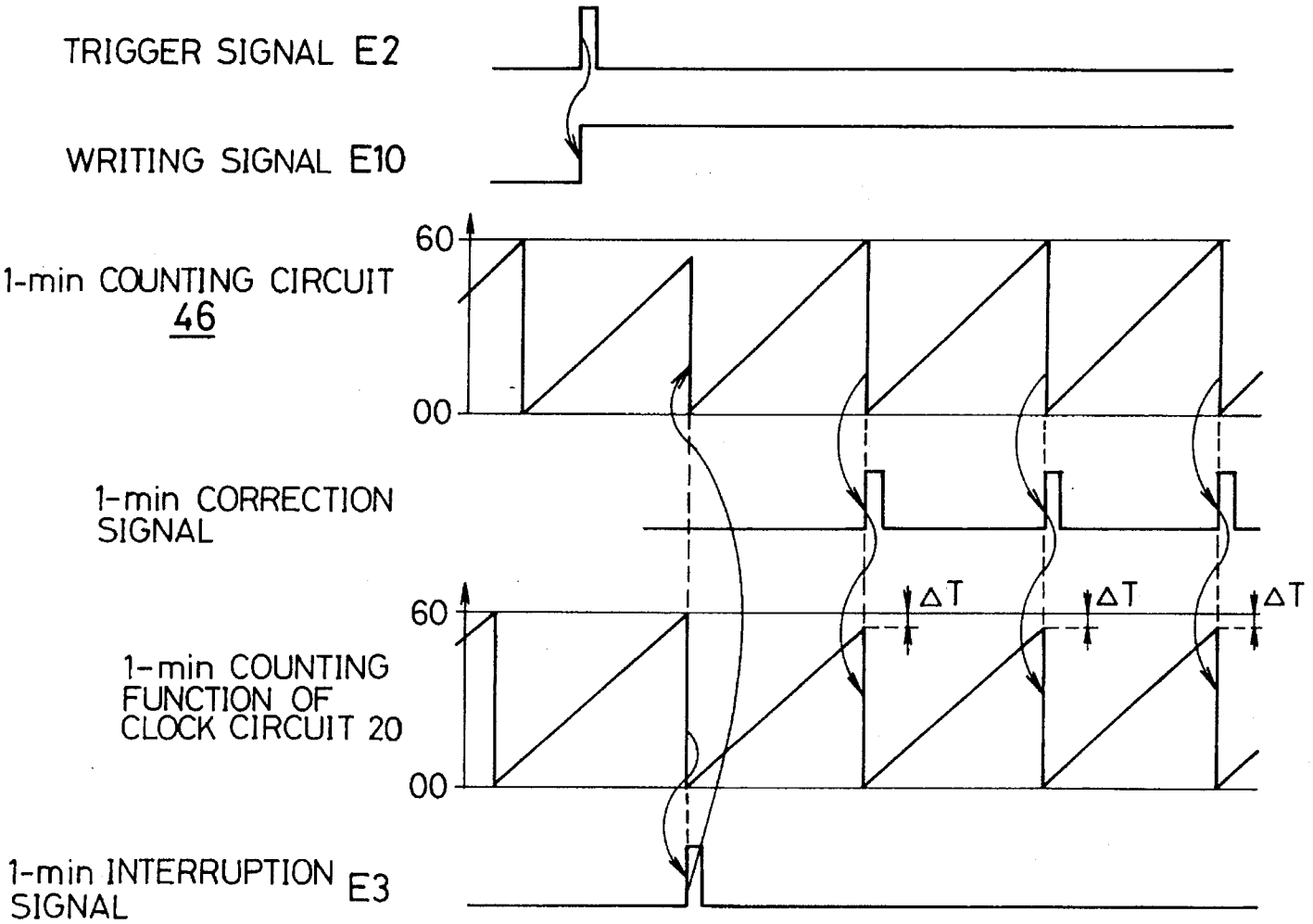
FIGS. 5A to 5F are timing charts for a synchronizing process and a correcting process of the high function clock control circuit and clock circuit in FIG. 1.

FIGS. 5A to 5F are timing charts for the time synchronization control between the clock circuit 20 and high precision clock control circuit 26 in FIG. 4 and the subsequent correction control. When the trigger signal E2 in FIG. 5A is input, the writing signal E10 in FIG. 5B from the trigger sync circuit 36 (refer to FIG. 3) provided in the high precision clock control circuit 26 is made effective. FIG. 5C shows the counting operation of the one-minute counting circuit 46 provided for the high precision clock control circuit 26. The counting operation in a range from 00 second to 60 seconds shown in an axis of ordinate is repeated. FIG. 5E shows the counting operation of the one-minute counting function built in the clock circuit 20. The counting operation in a range from 00 second to 60 seconds is similarly repeated. However, the one-minute counting functions on the sides of the one-minute counting circuit 46 in FIG. 5C and the clock circuit 20 in FIG. 5E are not synchronized as shown in the diagram in the initial state just after the turn-on of the power source.

When the writing signal E10 is made effective by the output of the trigger signal E2, the high precision clock control circuit 26 permits the acceptance of the one-minute interruption signal E3 in FIG. 5F from the clock circuit 20. Therefore, when the time reaches 60 seconds by the one-minute counting function in the clock circuit 20 in FIG. 5E and the one-minute interruption signal E3 is generated, the high precision clock control circuit 26 fetches the one-minute interruption signal E3, thereby forcedly performing the resetting operation of the one-minute counting circuit 46 in FIG. 5C. At this time point, the counting operation of the one-minute counting circuit 46 in FIG. 5C is synchronized with the one-minute counting function in the clock circuit 20 in FIG. 5E. After completion of the synchronization control, the output of the one-minute correction signal E4 from the high precision clock control circuit 26 in FIG. 5D is started. Namely, the one-minute correction signal E4 in FIG. 5D is output after completion of the measurement of one minute of the one-minute counting circuit 46 in the high precision clock control circuit 26 in FIG. 5C. As shown in FIG. 5E, the one-minute counting function on the clock circuit 20 side is delayed and its time is increased by only $\Delta T$. Therefore, before the one-minute counting function of the clock circuit 20 counts 60 seconds by the output of the one-minute correction signal E4, the clock circuit is forcedly reset by the completion of the counting of one minute by the one-minute counting circuit 46. The time data of the clock circuit 20 becomes the time data of a high precision based on 16 MHz from the high precision oscillator 28. In case of FIGS. 5A to 5E, the deviation of the clock circuit 20 in the measurement of one minute is extremely largely shown for convenience of explanation and such a deviation is actually suppressed to an error of a second or less. Therefore, the clock circuit 20 performs the counting operation perfectly synchronized with the one-minute counter of the high precision clock control circuit 26.

Figure 6:
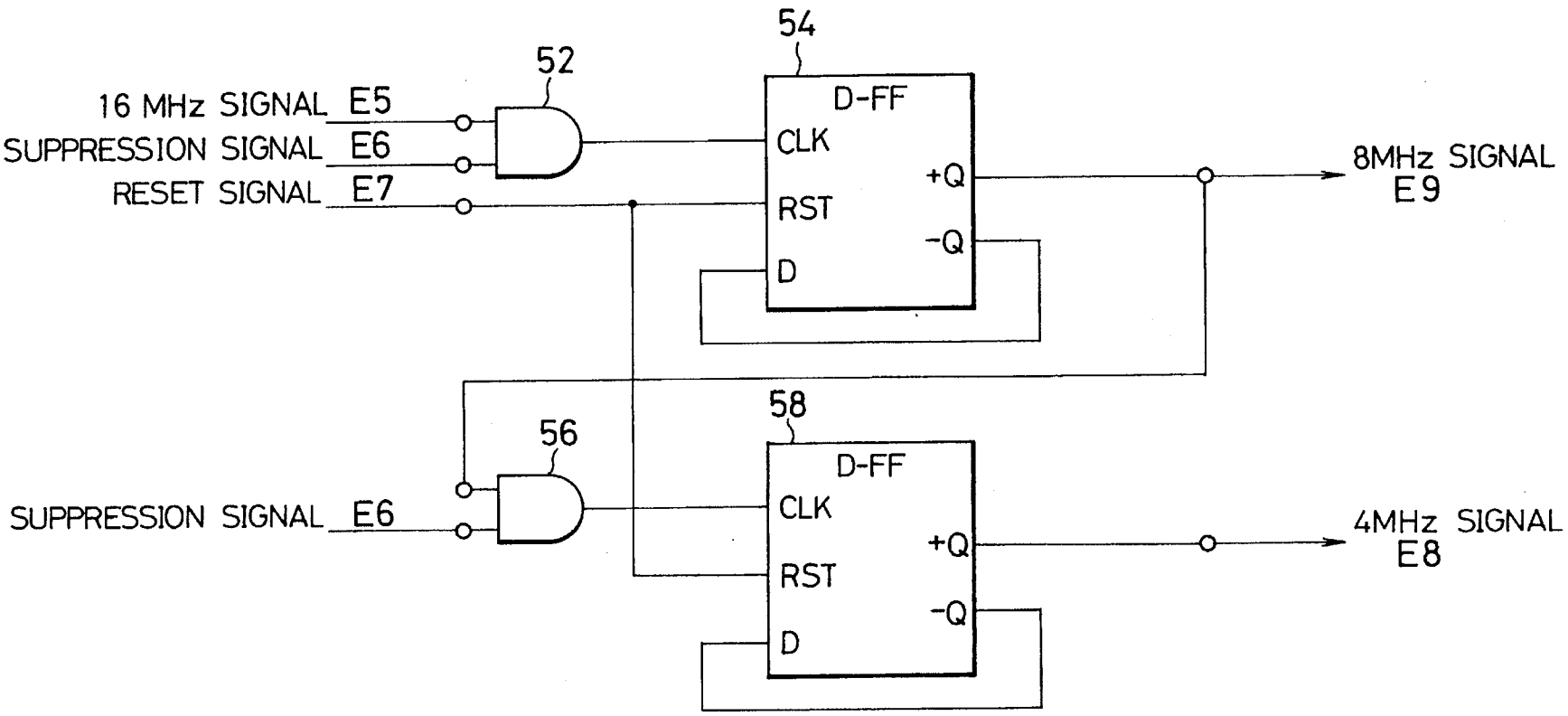
FIG. 6 is a block diagram of a ¼ frequency dividing circuit in FIG. 3.

FIG. 6 shows an embodiment of the ¼ frequency dividing circuit 34 provided for the high precision clock control circuit 26 in FIG. 3. The ¼ frequency dividing circuit 34 constructs a frequency dividing circuit in which D-FFs 54 and 58 are connected as two stages. The 16-MHz signal E5 from the high precision oscillator 28 is input to a clock terminal CLK of the D-FF 54 of the first stage through an AND gate 52. Therefore, the D-FF 54 outputs the 8-MHz signal E9 obtained by frequency dividing the 16-MHz signal E5 into ½. The 8-MHz signal E9 is input to a clock terminal CLK of the D-FF 58 of the second stage through an AND gate 56. Therefore, the D-FF 58 of the second stage outputs the 4-MHz signal E8 obtained by dividing the frequency of the 8-MHz signal E9 into ½. The AND gates 52 and 56 can inhibit the clock inputs to the D-FFs 54 and 58 by the suppression signal E6 from the outside. The reset signal E7 in association with the power-on-start from the outside is supplied to reset terminals RST of the D-FFs 54 and 58. Further, the 8-MHz signal E8 from the D-FF 54 of the first stage is output as a clock to the other circuit sections.

Figure 7:
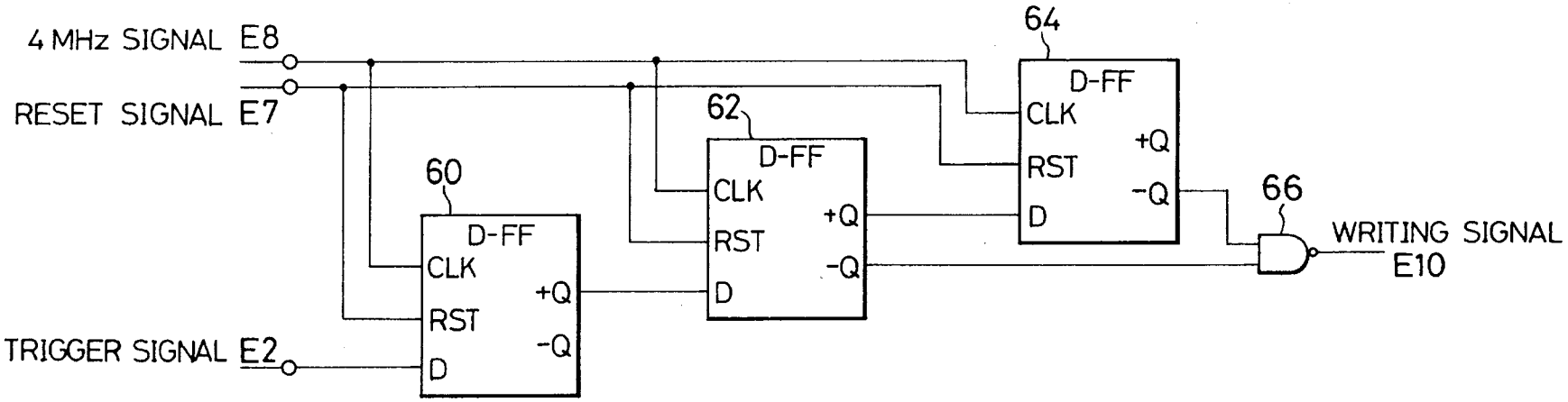
FIG. 7 is a block diagram of a trigger synchronizing circuit in FIG. 3.

FIG. 7 shows an embodiment of the trigger sync circuit 36 provided for the high precision clock control circuit 26 in FIG. 3. In the trigger sync circuit 36, D-FFs 60, 62, and 64 of three stages are connected and the writing signal E10 is finally output by the inverted AND of a +Q output of the D-FF 64 and a −Q output of the D-FF 62 through an AND gate 66. The trigger signal E2 from the outside is input to a D terminal of the D-FF 60 at the first stage. The 4-MHz signal E8 is input to clock terminals CLK of the D-FFs 60, 62, and 64. The reset signal E7 is commonly supplied to reset terminals RST. The trigger sync circuit 36 in FIG. 7 sequentially latches the trigger signal E2 from the outside in accordance with the order of the D-FFs 60, 62, and 64 synchronously with the 4-MHz signal E8 and generates the writing signal E10 at the third clock of the 4-MHz signal E8 from the input of the trigger signal E2. The trigger signal E2 is the signal synchronized with the CPU 10 and is asynchronized with the high precision clock control circuit 26. Therefore, the trigger sync signal 36 is constructed by the D-FFs 60, 62, and 64 of three stages, thereby synchronizing with the operation clock of the high precision clock control circuit 26.

Figure 8:
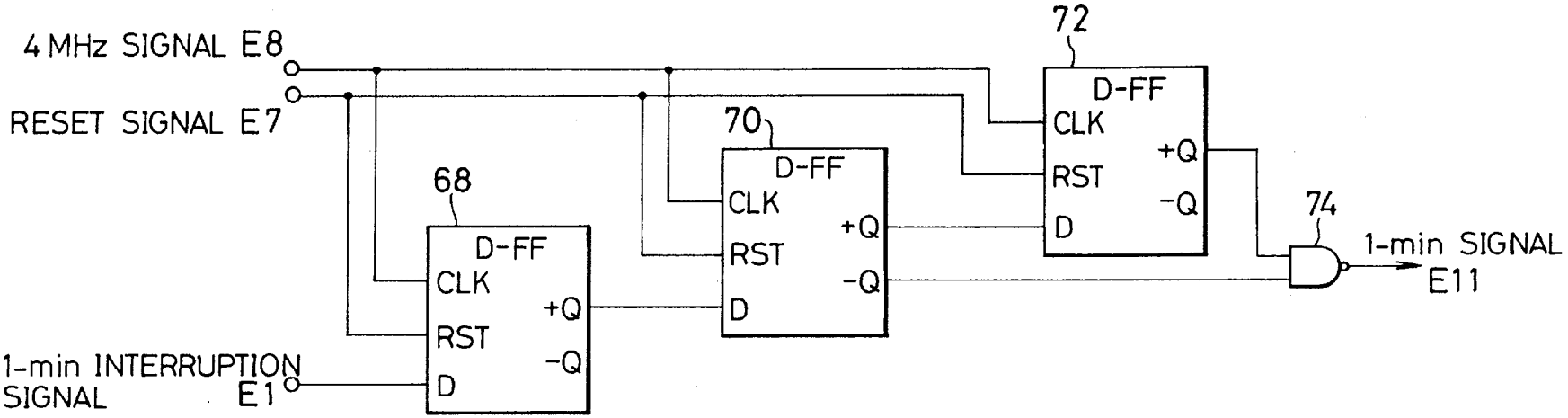
FIG. 8 is a block diagram of a one-minute interruption synchronizing circuit in FIG. 3.

FIG. 8 shows an embodiment of the one-minute interruption sync circuit 38 provided for the high precision clock control circuit 26 in FIG. 3. The one-minute interruption sync circuit 38 is constructed by D-FFs 68, 70, and 72 of three stages and has an NAND gate 74 at the final stage. The above circuit construction is substantially similar to that of the trigger sync circuit 36 in FIG. 7 except a different point that the one-minute interruption signal E1 is input to a D terminal of the D-FF 68 at the first stage.

Figure 9:
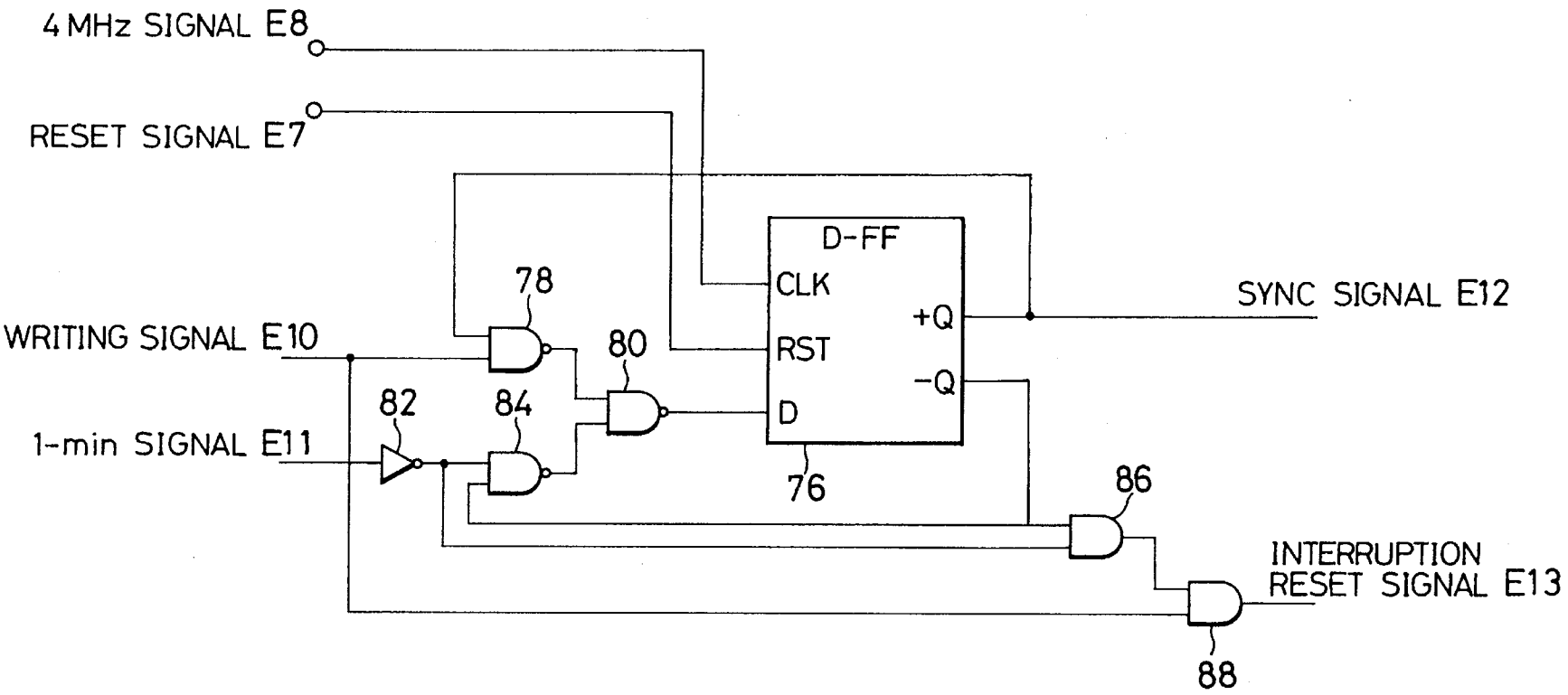
FIG. 9 is a block diagram of a clock control synchronizing circuit in FIG. 3.

FIG. 9 shows an embodiment of the clock control sync circuit 40 in the high precision clock control circuit 26 in FIG. 3. The clock control sync circuit 40 has a D-FF 76 which outputs the sync signal E12 from a +Q terminal. The signal based on the writing signal E10 and the one-minute signal E11 is input to a D terminal of the D-FF 76 by a logical circuit comprising NAND gates 78, 80, and 84 and an inverter 82. A circuit to output the interruption reset signal E13 is constructed by the inverter 82 and AND gates 86 and 88. The 4-MHz signal E8 is input to a clock terminal CLK of the D-FF 76. The reset signal E7 is input to a reset terminal RST. When the writing signal E10 is first input, the clock control sync circuit 40 in FIG. 9 sets the NAND gate 80 to a permitting state through the NAND gate 78 and also sets the AND gate 88 to the permitting state. When the one-minute signal E11 is input in this state, the signal is input to the D terminal of the D-FF 76 through the inverter 82, NAND gate 84, and further NAND gate 80. A +Q output is set to 1 by the inverting operation of the D-FF 76, so that the sync signal E12 is output. At the same time, the one-minute signal E11 is inverted by the inverter 82 and, after that, the inverted signal is generated as an interruption reset signal E13 through the AND gates 86 and 88.

Figure 10:
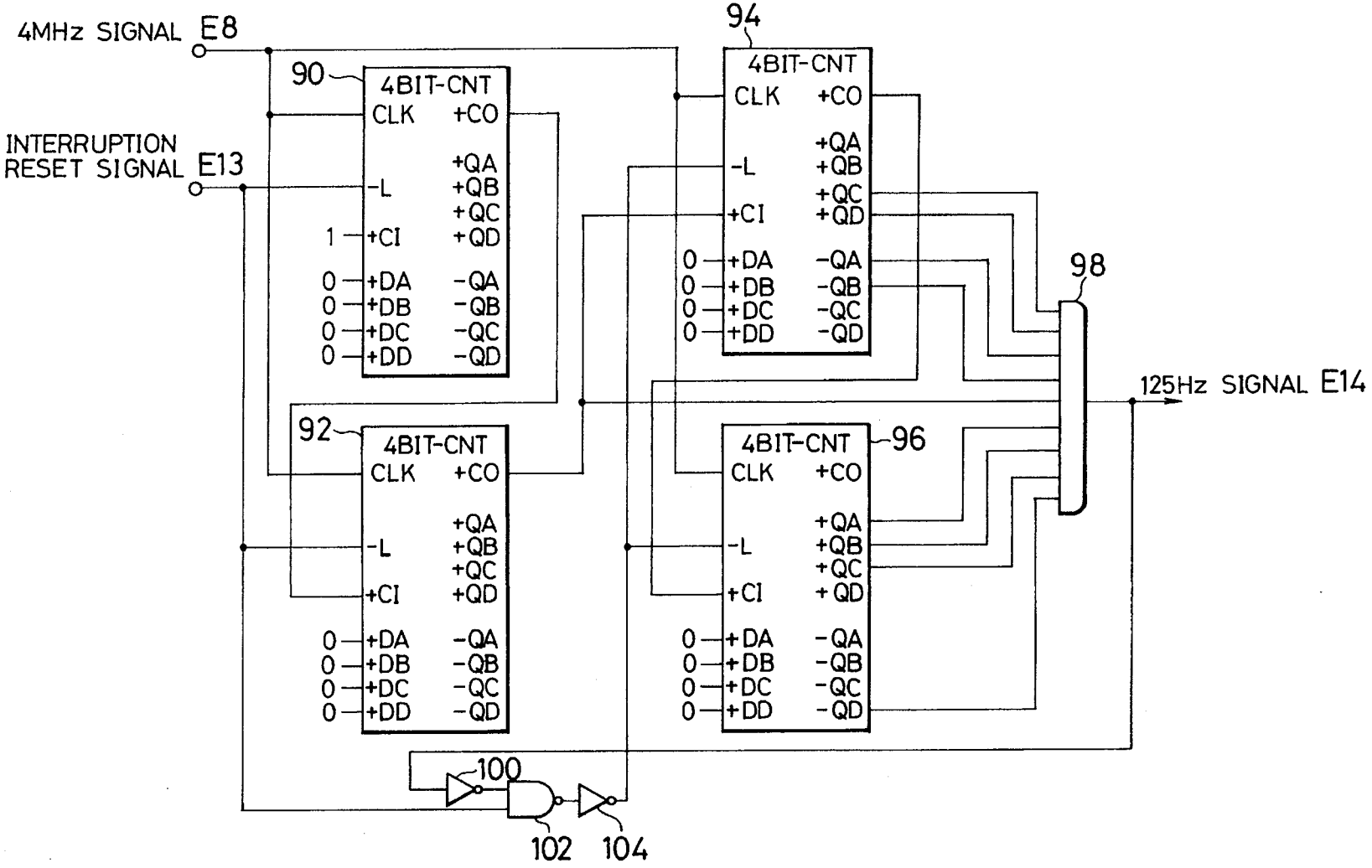
FIG. 10 is a block diagram of a 125-Hz counting circuit in FIG. 3.

FIG. 10 shows an embodiment of the 125-Hz counting circuit 42 provided for the high precision clock control circuit 26 in FIG. 3. The 125-Hz counting circuit 42 has 4-bit counters 90, 92, 94, and 96 and an AND gate 98. The 4-MHz signal E8 is input to clock terminals CLK of the 4-bit counters 90, 92, 94, and 96. The interruption reset signal E13 is input to reset terminals –L. An output terminal +CO of the 4-bit counter 90 at the first stage is connected to an input terminal +CI of the 4-bit counter 92 at the second stage. An output terminal +CO of the 4-bit counter 92 at the second stage is connected to an input terminal +CI of the 4-bit counter 94 at the third stage. An output terminal +CO of the 4-bit counter 94 at the third stage is connected to an input terminal +CI of the 4-bit counter 96 at the fourth stage. Count bit outputs +QC, +QD, –QA, and –QB of the 4-bit counter 94 at the third stage are input to the AND gate 98 at the final stage. Count bit outputs +QA, +QB, +QC, and –QD of the 4-bit counter 96 at the fourth stage are also input to the AND gate 98. When all bits which are input connected in the outputs of the 4-bit counters 94 and 96 at the third and fourth stages and all of the outputs +CO of the 4-bit counter 92 are equal to 1, the AND gate 98 generates the 125-Hz signal E14. That is, when 32000 4-MHz signals E8 are counted, the AND gate 98 generates the 125-Hz signal. When the 125-Hz signal E14 at the logical level 1 is generated from the AND gate 98, its pulse width is cancelled by resetting the 4-bit counters 94 and 96 by a reset circuit section comprising inverters 100 and 104 and an NAND gate 102 and the counting operation is again repeated.

Figure 11:
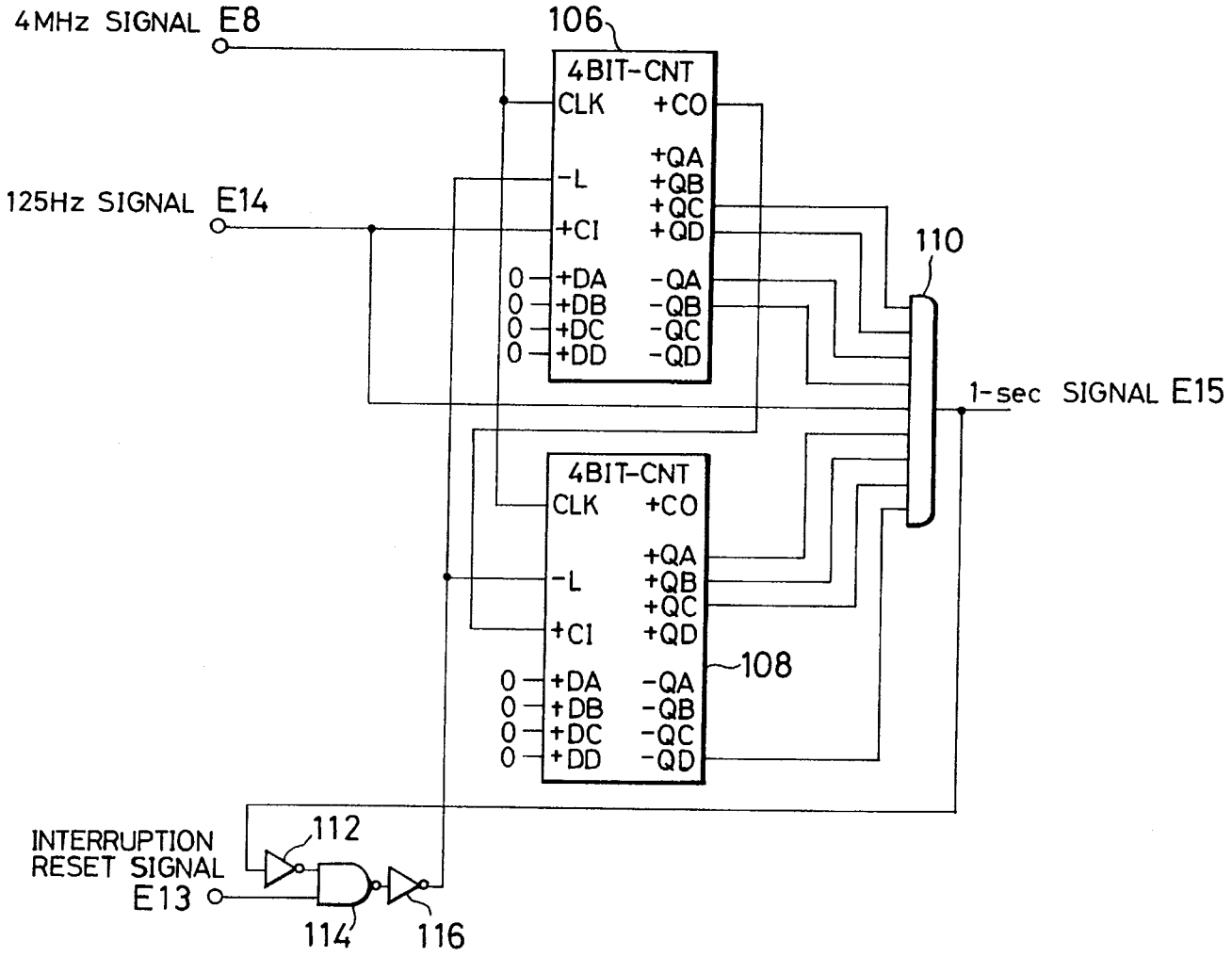
FIG. 11 is a block diagram of a one-second counting circuit in FIG. 3.

FIG. 11 shows an embodiment of the one-second counting circuit 44 provided for the high precision clock control circuit 26 in FIG. 3. The one-second counting circuit 44 is constructed by a reset circuit section comprising 4-bit counters 106 and 108, an AND gate 110, inverters 112 and 116, and an NAND gate 114. The 4-MHz signal E8 is input to clock terminals CLK of the 4-bit counters 106 and 108. The 125-Hz signal E14 is input to an input terminal +CI of the 4-bit counter 106 at the first stage. An output terminal +CO of the 4-bit counter 106 at the first stage is connected to an input terminal +CI of the 4-bit counter 108 at the second stage. Count bit outputs +QC, +QD, –QA, and –QB of the 4-bit counter 106 at the first stage and count bit outputs +QA, +QB, QC, and –QD of the 4-bit counter 108 at the second stage are input to the AND gate 110. The 125-Hz signal E14 is also input to the AND gate 110. When 125 125-Hz signals E14 are counted, the AND gate 110 set an output to the high (H) level and generates the one-second signal E15. The one-second signal E15 is reset in a feedback manner by a reset circuit section comprising the inverter 112, NAND gate 114, and inverter 116 and is again returned to the low (L) level.

Figure 12:
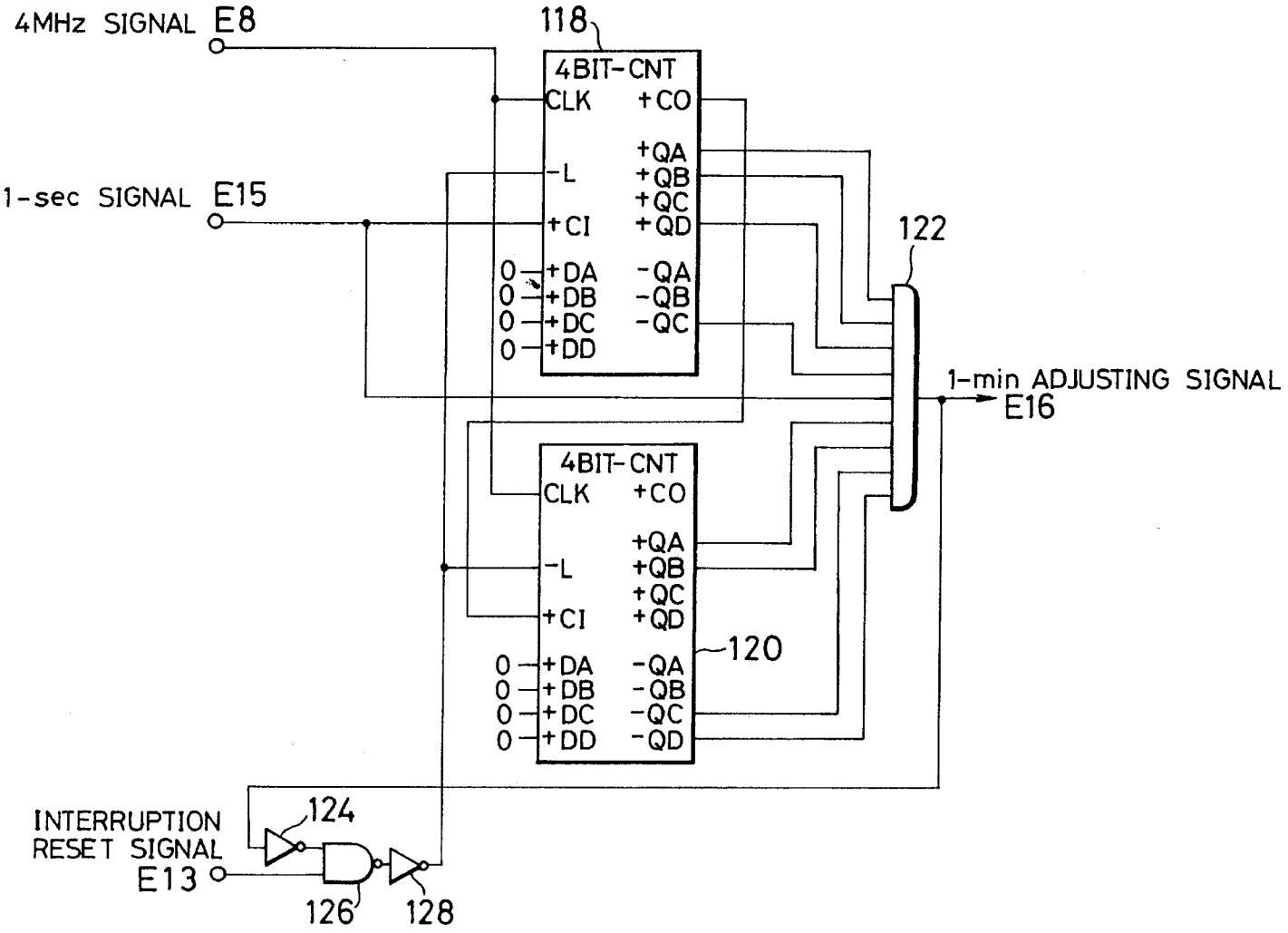
FIG. 12 is a block diagram of a one-minute counting circuit in FIG. 3.

FIG. 12 shows the one-minute counting circuit 46 provided for the high precision clock control circuit 26 in FIG. 3. The one-minute counting circuit 46 is constructed by a reset circuit section comprising 4-bit counters 118 and 120, an AND gate 122, inverters 124 and 128, and an NAND gate 126 and is fundamentally the same as the one-second counting circuit in FIG. 11. The AND gate 122 judges whether 60 one-second signals E15 have been counted by the 4-bit counters 118 and 120 or not. When 60 signals are counted, the AND gate 122 generates the one-minute adjusting signal E16.

Figure 13:
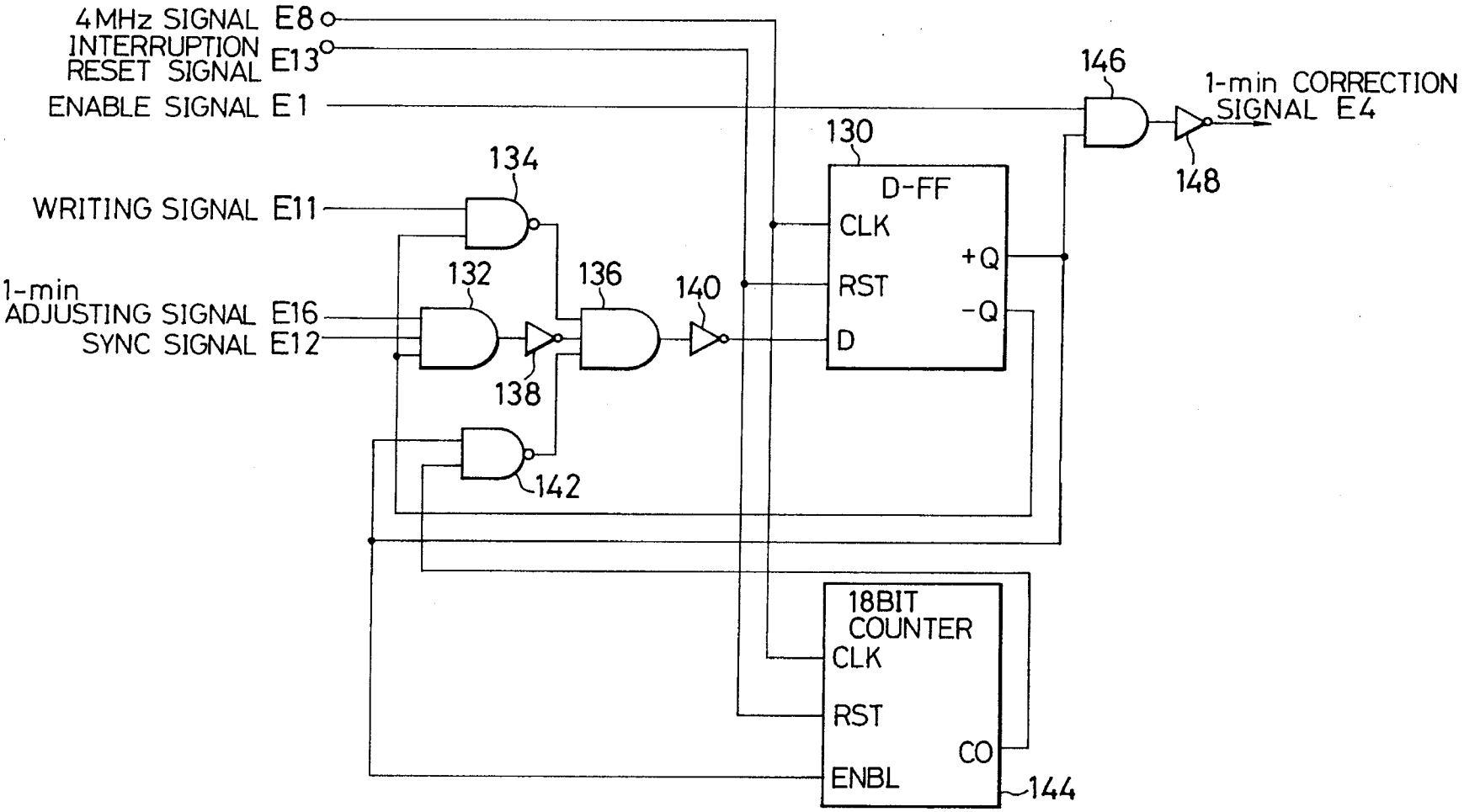
FIG. 13 is a block diagram of a one-minute correction signal transmitting circuit in FIG. 3.

FIG. 13 shows the one-minute correction signal transmitting circuit 48 shown in the high precision clock control circuit 26 in FIG. 3. The one-minute correction signal transmitting circuit 48 has a D-FF. An input circuit section comprising AND gates 132 and 136, NAND gates 134 and 142, and inverters 138 and 140 is provided for a D input terminal of a D-FF 130. An 18-bit counter 144 is further provided. An output circuit section using an AND gate 146 and an inverter 148 is provided at the output stage of the D-FF 130. The one-minute adjusting signal E16 is input to the D terminal of the D-FF 130 in a state in which the writing signal E11 and sync signal E12 are obtained. When a count output of one minute is derived from the 18-bit counter 144, the effective input is performed, a +Q output of the D-FF 130 is set to 1, and the one-minute correction signal E4 is generated through the AND gate 146 and inverter 148.

According to the present invention as described above, the relatively cheap clock IC of a high function can be made operative at a high precision by adding a simple hardware and the clock apparatus of a high precision which is used in the computer system can be easily obtained.

Although the clock circuit 20 having the oscillator therein has been used in the embodiment, a type in which the oscillator is attached from the outside can be also used. In the externally attaching type, it is necessary to adjust the CR component. It will be obviously understood that the clock apparatus of the invention is not limited to the small computer system such as workstation, server machine, or the like but can be further also used as a high precision clock apparatus of a cheap personal computer or, contrarily, a large general computer system.

What is claimed is:

1. A clock apparatus for forming time information, comprising:

a clock circuit to generate time information based on a clock signal of a first oscillator and to correct said time information based on an externally supplied and received correction signal including correcting a value of a second in said time information to 0 when said value of said second in said time information is equal to or larger than 0 seconds and less then 30 seconds and correcting said value to 0 when said value of said second in said time information is equal to or larger than 30 seconds and less than 59 seconds by carrying a value of one minute based on said received correction signal;

a second oscillator to generate a second clock signal of a frequency which is stable during a change in ambient temperature; and a high precision clock control circuit to repeat a measurement of a predetermined unit time based on said second clock signal from said second oscillator and to output said correction signal to said clock circuit each time the measurement of said predetermined unit time is completed, thereby correcting said time information.

2. An apparatus according to claim 1, wherein in said second oscillator, an oscillating circuit section is enclosed in a package of a thermostat structure.

3. An apparatus according to claim 1, wherein said high precision clock control circuit comprises a sync control circuit for synchronizing the time information based on the clock signal from said second oscillator with the time information from said clock circuit when a synchronization instruction signal from the outside is received.

4. An apparatus according to claim 3, wherein said sync control circuit resets a counter for producing said time information by a time interruption signal of every said predetermined unit time which is output from said clock circuit, thereby synchronizing with the time information of the clock circuit.

5. An apparatus according to claim 3, wherein said high precision clock control circuit includes a correction signal transmitting circuit for repeating the measurement of said predetermined unit time on the basis of the clock signal from said high precision oscillator after completion of the synchronization by said sync control circuit and for transmitting the correction signal to said clock circuit every completion of the measurement of said predetermined unit time, thereby correcting said time information.

6. An apparatus according to claim 1, further comprising:

a sync interruption generating circuit for transmitting a synchronization instruction signal to said high precision clock control circuit by a command from a computer apparatus; and a high precision clock selecting circuit for allowing the transmission of the correction signal from said high precision clock control circuit by a command from said computer apparatus.

7. An apparatus according to claim 6, wherein said sync interruption generating circuit decodes an initialization command in association with a turn-on of a power source of said computer apparatus and transmits the synchronization instruction signal to said high precision clock control circuit.

8. An apparatus according to claim 6, wherein said high precision clock selecting circuit transmits a selection signal to said high precision clock control circuit at the time of the operation by an AC power source and suppresses the transmission of said selection signal to said high precision clock control circuit, thereby making only said clock circuit operative at the time of the operation by a built-in battery power source.

* * * * *